US007172844B2

(12) United States Patent
Umemura et al.

(10) Patent No.: US 7,172,844 B2
(45) Date of Patent: Feb. 6, 2007

(54) TONER FOR ELECTROPHOTOGRAPHY, AND IMAGE FORMING PROCESS, PROCESS CARTRIDGE AND IMAGE FORMING APPARATUS USING THE SAME

(75) Inventors: Kazuhiko Umemura, Shizuoka (JP); Satoshi Mochizuki, Shizuoka (JP); Yasuaki Iwamoto, Shizuoka (JP); Yasuo Asahina, Shizuoka (JP); Hideki Sugiura, Shizuoka (JP); Tomoyuki Ichikawa, Shizuoka (JP); Shinya Nakayama, Shizuoka (JP); Koichi Sakata, Shizuoka (JP); Tomoko Utsumi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 284 days.

(21) Appl. No.: 10/784,204

(22) Filed: Feb. 24, 2004

(65) Prior Publication Data

US 2004/0229143 A1 Nov. 18, 2004

(30) Foreign Application Priority Data

Feb. 25, 2003 (JP) ..... 2003-047173

(51) Int. Cl.
*G03G 9/087* (2006.01)
*G03G 9/08* (2006.01)

(52) U.S. Cl. ..... 430/108.4; 430/109.4; 430/111.4; 430/108.1; 430/124; 430/110.3

(58) Field of Classification Search ..... 430/109.4, 430/111.4, 108.4, 108.1, 110.3, 124
See application file for complete search history.

(56) References Cited

U.S. PATENT DOCUMENTS 5,156,937 A * 10/1992 Alexandrovich et al. 430/109.4
5,234,784 A * 8/1993 Aslam et al. ..... 430/99
5,254,426 A * 10/1993 Aslam et al. ..... 430/111.4
5,328,792 A * 7/1994 Shigemori et al. ..... 430/110.3
5,462,829 A * 10/1995 Tyagi et al. ..... 430/109.4
6,333,131 B1 * 12/2001 Ishiyama et al. ..... 430/111.4
6,542,707 B2 4/2003 Muramatsu et al.
6,558,864 B2 * 5/2003 Ishiyama et al. ..... 430/108.6
6,597,883 B2 7/2003 Muramatsu et al.
6,628,908 B2 9/2003 Matsumoto et al.
6,628,913 B2 9/2003 Matsumoto et al.
6,630,276 B2 10/2003 Sugiura et al.
6,667,141 B2 12/2003 Iwamoto et al.

OTHER PUBLICATIONS

U.S. Appl. No. 10/020,925, filed Dec. 19, 2001, Mochizuki et al.
U.S. Appl. No. 10/059,240, filed Jan. 31, 2002, Sugiura et al.
U.S. Appl. No. 10/059,239, filed Jan. 31, 2002, Mochizuki et al.
U.S. Appl. No. 10/086,415, filed Mar. 4, 2002, Sugiura et al.
U.S. Appl. No. 10/077,813, filed Feb. 20, 2002, Matsuda et el.
U.S. Appl. No. 10/101,756, filed Mar. 21, 2002, Sasaki et al.
U.S. Appl. No. 10/107,157, filed Mar. 28, 2002, Masuda et al.
U.S. Appl. No. 10/151,103, filed May 21, 2002, Kondo et al.
U.S. Appl. No. 10/153,627, filed May 24, 2002, Suzuki et al.
U.S. Appl. No. 10/176,578, filed Jun. 24, 2002, Yagi et al.
U.S. Appl. No. 10/212,736, filed Aug. 7, 2002, Sugiura et al.
U.S. Appl. No. 10/318,109, filed Dec. 13, 2002, Sugiura et al.
U.S. Appl. No. 10/329,538, filed Dec. 27, 2002, Higuchi et al.
U.S. Appl. No. 10/383,750, filed Mar. 10, 2003, Nakai et al.
U.S. Appl. No. 10/385,719, filed Mar. 12, 2003, Sugiura et al.
U.S. Appl. No. 10/391,575, filed Mar. 20, 2003, Suzuki et al.
U.S. Appl. No. 10/607,014, filed Jun. 27, 2003, Tomita et al.
U.S. Appl. No. 10/609,399, filed Jul. 1, 2003, Katoh et al.

* cited by examiner

*Primary Examiner*—Christopher Rodee
(74) *Attorney, Agent, or Firm*—Oblon, Spivak, McClelland, Maier & Neustadt, P.C.

(57) ABSTRACT

A toner for electrophotography contains a binder resin, a colorant and a releasing agent and has a viscosity, a storage modulus (G') and a loss modulus (G"), in which the viscosity is $1\times10^3$ Pa·s or more and a loss tangent (tan δ) as the ratio of G' to G" is 0.4 or more at temperatures from 140° C. to 170° C.

15 Claims, 5 Drawing Sheets

TONER FOR ELECTROPHOTOGRAPHY, AND IMAGE FORMING PROCESS, PROCESS CARTRIDGE AND IMAGE FORMING APPARATUS USING THE SAME

BACKGROUND OF THE INVENTION

1. Field of the Invention

The present invention relates to a toner for electrophotography and an image forming process, process cartridge and image forming apparatus using the toner.

2. Description of the Related Art

In electrophotography, a latent electrostatic image is formed on a photoconductor comprising a photoconductive substance, the latent electrostatic image is developed using a developer to form a toner image, the toner image is transferred to a transfer medium such as paper according to necessity, and the toner image is fixed thereon, for example, by heating and/or pressurizing to form a visible image. In electrophotography for forming color images, a document is exposed to light using a color separation filter, or an image is read from the document using a scanner and is written to a photoconductor using laser light to thereby form a latent electrostatic image of, for example, a yellow image area. The latent electrostatic image is then developed using a developer containing a yellow toner to form a yellow toner image, the yellow toner image is transferred to and fixed on a transfer medium such as paper, and a magenta toner image and a cyan toner image are then sequentially formed and fixed thereon to yield a color image.

Demands have been made on image formation using electrophotography to improve image quality, to perform image formation at higher speed, to provide more downsized apparatus and to provide image formation with higher reliability. In particular in the formation of color images, colors must be reproduced in a wide range at a higher resolution. Thus, attempts have been made to decrease the softening points of color toners and to decrease the melt viscosity thereof to thereby improve color mixing in color toners of two or more colors.

However, toners having such thermal properties often invite offset to fixing rollers such as heating rollers upon heating and image-fixing procedure. To prevent offset, a technique of applying a releasing oil such as a silicone oil to the surface of the heating rollers, and a technique of adding a releasing agent to a toner have been proposed as disclosed in Japanese Patent Application Laid-Open (JP-A) Nos. 50-144446, 60-123856, 01-109360, 03-5764, 04-9067, 04-230769 and 08-50367.

However, the former technique requires an oil applicator, thus requires a complicated fixer and invites odor caused by the releasing oil upon image fixing. The latter technique invites filming on the surface of the photoconductor and is often deposited on the carrier in the developer or on a developing sleeve. In addition, a toner using a resin having a low melt viscosity cannot sufficiently prevent offset.

JP-A No. 11-282198 discloses a toner having a specific storage modulus and loss tangent (tan δ) and describes the use of crosslinked polymer as a binder resin. However, the present inventors have found that the single use of crosslinked polymer may not satisfactorily control the viscoelasticity of the toner, and process conditions such as the temperature in heating and image-fixing must be precisely controlled.

Objects and Advantages

Under these circumstances, an object of the present invention is to provide a toner which can be satisfactorily used in a low-temperature image-fixing system, has good offset resistance and is not deposited on image-fixing devices and images. Another object of the present invention is to provide a toner which can be satisfactorily transferred and removed from members in a process of cleaning and can produce sharp and clear visible images over a long period of time. Still another object of the present invention is to provide a process cartridge, image forming apparatus and image forming process using the toner.

SUMMARY OF THE INVENTION

After intensive investigations, the present inventors have found that a toner having specific viscoelastic properties is effective to achieve the above objects. The present invention has been accomplished based on these findings.

Specifically, the first aspect of the present invention is a toner for electrophotography, containing a binder resin, a colorant and a releasing agent, being in the form of particles and having a viscosity, a storage modulus (G') and a loss modulus (G"), wherein the viscosity is $1\times10^3$ Pa·s or more and a loss tangent (tan δ) as the ratio of G' to G" is 0.4 or more at temperatures from 140° C. to 170° C.

The second aspect of the present invention is a toner according to the first aspect, wherein the viscosity of the toner is $1\times10^5$ Pa·s or less at temperatures from 140° C. to 170° C.

The third aspect of the present invention is a toner according to the first aspect, wherein the loss tangent (tan δ) of the toner is 1.1 or less at temperatures from 140° C. to 170° C.

The fourth aspect of the present invention is a toner according to the first aspect, wherein pellets prepared from the toner by compression molding have a contact angle with water of 70 degrees or more.

The fifth aspect of the present invention is a toner according to the first aspect, wherein the toner particles have a volume-average particle diameter Dv of 4 to 8 μm.

The sixth aspect of the present invention is a toner according to the first aspect, wherein the toner particles have a ratio (Dv/Dn) of a volume-average particle diameter (Dv) to a number-average particle diameter (Dn), being 1.25 or less.

The seventh aspect of the present invention is a toner according to the sixth aspect, wherein the toner particles have a ratio (Dv/Dn) of a volume-average particle diameter (Dv) to a number-average particle diameter (Dn), being 1.10 or more.

The eighth aspect of the present invention is a toner according to the first aspect, wherein the toner particles have an average sphericity of from 0.94 to 0.99.

The ninth aspect of the present invention is a toner according to the eighth aspect, wherein the toner particles have an average sphericity of from 0.945 to 0.985.

The tenth aspect of the present invention is a toner according to the first aspect, wherein the binder resin contains a crosslinked polymer and a linear polymer.

The eleventh aspect of the present invention is a toner according to the tenth aspect, wherein the linear polymer has a softening point of 50° C. or lower.

The twelfth aspect of the present invention is a toner according to the first aspect, wherein the binder resin contains at least one of a polyester resin and a polyol resin.

The thirteenth aspect of the present invention is a toner according to the first aspect, wherein the releasing agent is at least one selected from the group consisting of unesterified fatty acid eliminated carnauba wax, montan ester wax, rice wax and Sasol wax.

The fourteenth aspect of the present invention is an image forming process containing the steps of: charging a latent electrostatic image bearing member with a charger which is applied with a voltage; irradiating the latent electrostatic image bearing member with the light so as to form a latent electrostatic image; developing the latent electrostatic image using a toner so as to form a toner image; transferring the toner image from the latent electrostatic image bearing member to a transfer medium; and fixing the toner image on the transfer medium, wherein the toner is a toner for electrophotography, containing a binder resin, a colorant and a releasing agent, being in the form of particles and having a viscosity, a storage modulus (G') and a loss modulus (G"), in which the viscosity is $1\times10^3$ Pa·s or more and a loss tangent (tan δ) as the ratio of G' to G" is 0.4 or more at temperatures from 140° C. to 170° C.

The fifteenth aspect of the present invention is an image forming process according to the fourteenth aspect, further containing a step of applying an alternating electric field at the same time of developing the latent electrostatic image.

The sixteenth aspect of the present invention is a process cartridge being attachable to and detachable from a main body of an image forming apparatus, containing: a latent electrostatic image bearing member; and at least one selected from the group consisting of a charging unit configured to charge the latent electrostatic image bearing member, developing unit housing a toner, configured to develop a latent electrostatic image using the toner to form a toner image, and a cleaning unit configured to clean residual toner remained on the latent electrostatic image bearing member after transfer, wherein the toner is a toner for electrophotography, containing a binder resin, a colorant and a releasing agent, being in the form of particles and having a viscosity, a storage modulus (G') and a loss modulus (G"), in which the viscosity is $1\times10^3$ Pa·s or more and a loss tangent (tan δ) as the ratio of G' to G" is 0.4 or more at temperatures from 140° C. to 170° C.

The eighteenth aspect of the present invention is an image forming apparatus containing: a latent electrostatic image bearing member; a charging unit equipped with a charger, configured to bring the charger into contact with the latent electrostatic image bearing member and to apply a voltage to the charger so as to charge the latent electrostatic image bearing member; an exposing unit configured to irradiate the latent electrostatic image bearing member with light so as to form a latent electrostatic image; a developing unit housing a toner, configured to transfer the toner image from the latent electrostatic image bearing member to a transfer medium; and a fixing unit configured to fix the toner image on the transfer medium, wherein the toner is a toner for electrophotography, containing a binder resin, a colorant and a releasing agent, being in the form of particles and having a viscosity, a storage modulus (G') and a loss modulus (G"), in which the viscosity is $1\times10^3$ Pa·s or more and a loss tangent (tan δ) as the ratio of G' to G" is 0.4 or more at temperatures from 140° C. to 170° C.

DESCRIPTION OF THE PREFERRED EMBODIMENTS

Figure 1:
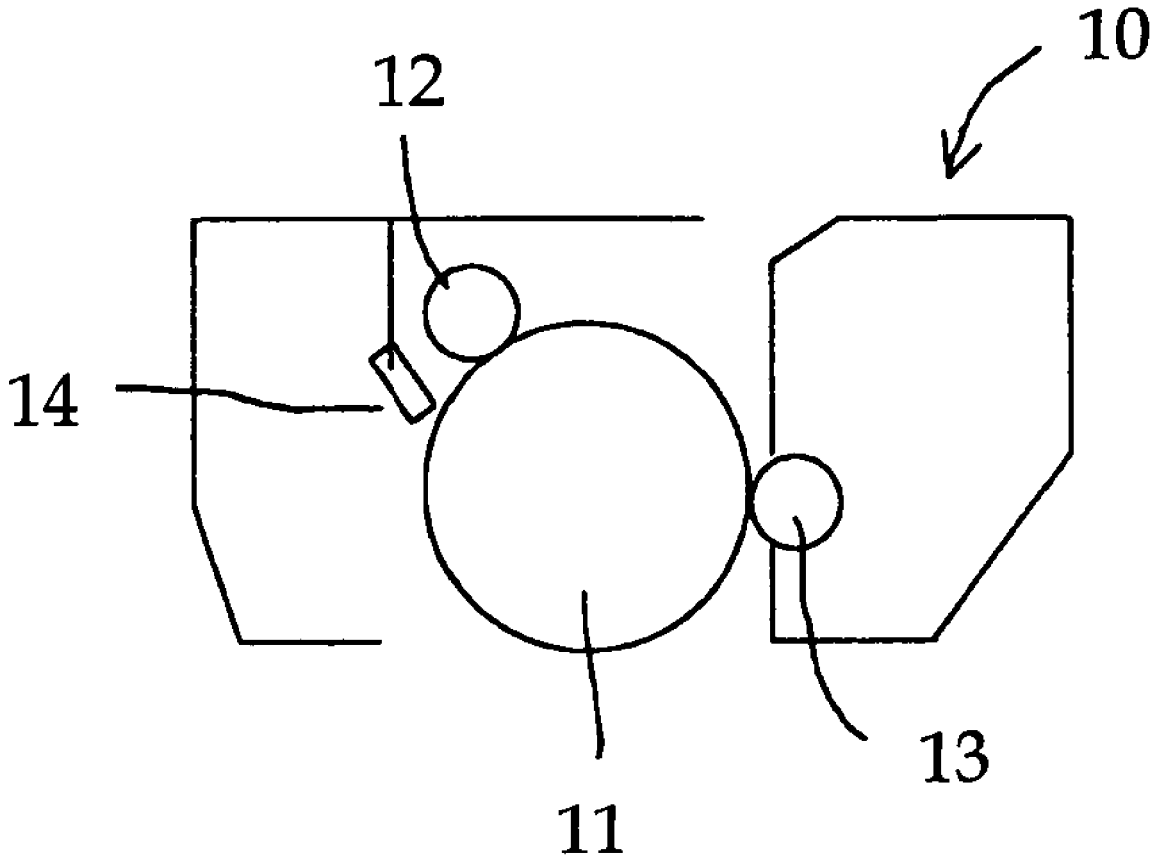
FIG. 1 is a schematic diagram showing an example of a process cartridge according to the present invention.

The toner of the present invention has a viscosity of $1\times10^3$ Pa·s or more at temperatures from 140° C. to 170° C. and a loss tangent (tan δ) as the ratio of a storage modulus G' to a loss modulus G" of 0.4 or more at temperatures from 140° C. to 170° C.

The present inventors have found that the control of viscoelasticity as above yields a toner which can be satisfactorily fixed at a wide range of temperatures.

The rheological properties of the toner will be described below. The image-fixing properties of a toner for image fixing with a heat roller are closely related to the melt viscoelasticity of the toner. The melt viscoelasticity of such a toner for image fixing with a heat roller has been determined using a flow tester or by melt index. These techniques can only determine the apparent viscosity of a melted article. However, a melted toner is a typical viscoelastic substance which shows both viscosity and elasticity, and the viscoelastic properties of the toner must be quantitatively analyzed.

Measuring methods for viscoelastic properties are classified as static measuring methods and dynamic measuring methods. The static measuring methods include a creep measuring method, in which a predetermined pressure is applied momentarily to a sample, and the time dependency of the stress of the sample is determined. In the measurement of creep, a completely elastic substance shows a constant strain with a time dependency substantially equal to zero. In contrast, a completely viscous substance shows an infinitely increasing strain. The melted toner is a viscoelastic substance showing the both properties and shows a strain depending on time. The speed of the strain is a strain rate and a change in strain under a constant stress. A low strain rate means that the time dependency is low and the article has a structure near to an elastic substance. This property is advantageous for high hot-offset resistance but is disadvantageous for good image-fixing properties. In contrast, a high strain rate means that the time dependency is high and the article has a structure near to a viscous substance. This property is advantageous for good image-fixing properties but disadvantageous for high hot-offset resistance.

The strain rate can be determined, for example, by the following method. A total of 0.1 to 0.2 g of a sample toner is placed on a 2-cm parallel plate. Using a CSL 100 Rheometer available from CARRI-MED Ltd., a predetermined stress of, for example, 10 to 100 Pa·s is applied to the sample toner at a predetermined temperature of, for example, 130° C. to 180° C. for a predetermined time of, for example, 10 minutes. The strain of the sample is determined after the predetermined time. The strain rate is determined based on the slope of the strain between the initial strain and the strain after the predetermined time.

The viscosity of toner of the present invention at temperatures from 140° C. to 170° C. should be $1\times10^3$ Pa·s or more and is preferably $1\times10^5$ Pa·s or less, and more preferably from $2\times10^3$ to $5\times10^4$ Pa·s.

The creep measuring method is one of static measuring methods. However, the toner behaves with high-speed responsibility in actual image fixing, and the dynamic viscoelasticity relating to stimulus-response in a short time must be quantitatively analyzed in addition to the measurement of creep. More specifically, in dynamic viscoelasticity of a toner, a storage modulus G' relates to the cohesive force of the toner, and a loss modulus G" relates to the viscosity of the toner. An increased storage modulus G' invites an increased cohesive force to reduce the offset but to deteriorate the image-fixing properties. In contrast, an increased loss modulus G" leads to improved image-fixing properties but to deteriorated offset resistance.

The dynamic viscoelasticity of a toner can be determined, for example, by the following method. The toner is hot-pressed into pellets 20 mm square and 2 mm thick as a test sample. While holding the test sample at a predetermined temperature, a sine vibration at a measuring frequency of 10 to 100 Hz is applied to the test sample in a shearing direction by a non-resonant forced vibration technique using DVE Rheospectrer available from Rheology Co., Ltd. as a measuring apparatus. The stress-response with a very small displacement is measured. The storage modulus (G'), loss modulus (G"), viscosity (σ) and loss tangent (tan δ) are determined based on the power and dynamic strain.

The loss tangent (tan δ) as the ratio of the storage modulus (G') to the loss modulus (G") of the toner of the present invention should be 0.4 or more, is preferably 0.4 or more and 1.2 or less at temperatures from 140° C. to 170° C.

The operation of the present invention has not yet been sufficiently clarified, but the present inventors consider as follows. When a toner image is fixed using a heat roller in a fixing unit of an electrophotographic apparatus, the toner rises in temperature and deforms in a very short time. If the loss modulus and/or viscosity of the toner is excessively low, the toner excessively deforms to thereby have a larger contact area with the fixing roller or belt, thus often inviting offset.

The toner preferably comprises a linear polymer having a sufficiently low softening point in addition to the crosslinked polymer as the binder resin. The combination use of the linear polymer enhances deformation at temperatures within which image-fixing is performed.

From this viewpoint, the linear polymer preferably has a softening point of 50° C. or lower.

In the toner of the present invention, pellets prepared from the toner by compression molding preferably have a contact angle with water of 70 degrees or more. The contact angle can be determined, for example, by measuring a contact angle with ion-exchanged water using a commercially available contact angle meter or visually observing through a loupe. It is understood that in a toner having an increasing contact angle with water, the releasing agent resides near to the toner surface and thereby exhibits higher releasing capability, thus further preventing the offset.

More specifically, the contact angle of the toner with water can be determined, for example, by a droplet technique using an automatic contact angle meter available from Kyowa Interface Science CO., LTD., in which the toner is molded into a pellet 20 mm square and 2 mm thick by high-pressure pressing; pure water is added dropwise onto the pellet; and the angle of the droplet formed on the pellet is determined.

Sphericity and Sphericity Distribution

The toner of the present invention preferably has a specific shape and specific distribution in shape. A toner having an average sphericity of less than 0.94 and having an irregular shape apart from sphere may not produce sufficient transfer ability and high-quality images without scattering of toner particles (dust). The sphericity of the toner is preferably determined by an optical detection band method, wherein a particle-containing suspension is allowed to pass through a photographic detection band on a plate, and the particle images are optically detected and analyzed with a CCD camera. The average sphericity is determined by dividing a boundary length of a corresponding circle having an equal projected area by a boundary length of the measured particle. The present inventors have found that a toner having an average sphericity of from 0.94 to 0.99 is effective to produce images with an appropriate density and high precision and reproducibility.

The average sphericity of the toner is more preferably from 0.95 to 0.98 and further preferably from 0.96 to 0.98. The content of particles having a sphericity of less than 0.94 in the toner is preferably 10% by number or less. A toner having an average sphericity exceeding 0.99 may invite cleaning failure of a photoconductor and/or transfer belt and thereby stain or deposition of toner particles on images in a system employing, for example, blade cleaning. In development and transfer of an image with a low image occupancy, the amount of a residual toner after transfer is small and the cleaning failure does not become a problem. However, in development and transfer of an image with a high image occupancy or in the case that an untransferred toner constituting an image remains on the photoconductor, the cleaning failure leads to toner deposition on the background of images. In addition, such a residual toner may be deposited on a charger roller for contact-charging the photoconductor and other members, thus reducing the inherent charging ability.

The sphericity is determined as the sphericity on average by a flow type particle image analyzer FPIA-1000 (trade name, available from Sysmex Corporation). Specifically, the measurement is performed by adding 0.1 ml to 0.5 ml of a surfactant such as an alkylbenzene sulfonate as a dispersing agent to 100 ml to 150 ml of water in a vessel from which solid impurities have been removed, and then adding approximately 0.1 g to 0.5 g of the test sample. The suspension, in which the test sample is dispersed, is subjected to dispersion treatment for approximately 1 minute to 3 minutes by an ultrasonic disperser, and the shape and distribution of the toner particles are determined by the above apparatus at a dispersion concentration of 3,000 particles per microliter to 10,000 particles per microliter.

Particle Diameter Distribution Dv/Dn

The toner has a volume-average particle diameter Dv of preferably from 4 μm to 8 μm and a ratio Dv/Dn of the volume-average particle diameter to a number-average particle diameter Dn of preferably 1.25 or less and more preferably from 1.10 to 1.25, from the viewpoints of excellent heat-resistant storability, image-fixing properties at low temperatures, and hot offset resistance. By satisfying the above-mentioned preferred ranges, especially glossiness of an image becomes excellent when the toner is used in a full-color copier. Further, when the toner is used in a two-component developer, variation of the toner particle diameter is minimized even after repeating cycles of consumption and addition of the toner with respect to carrier. As the toner keeps a narrow average particle diameter distribution without being affected by stirring in a developing device for a long period, the developer can keep stable and excellent developing properties. When the toner is used as a one-component developer, the variation of the toner particle diameter is minimized as in the two-component developer. In addition, filming of the toner to a development roller, and toner fusion to members such as toner blade which controls the toner thickness on the development roller are also prevented. Hence, even if the toner is used (stirred) in the developing device for a long period of time, the toner can keep stable and excellent developing properties to form high-quality images.

It is generally believed that the smaller a toner diameter is, the higher an image resolution and image quality are. However, the toner having a smaller diameter may be insufficient in transfer ability and cleaning property. A toner having a volume-average particle diameter of less than 4 μm used as a two-component developer tends to fuse onto a surface of carrier by being stirred in the developing device for a long period of time and thus charging ability of the carrier is impaired. In addition, in the case of a one-component developer, filming of the toner to a development roller, and toner fusion to members such as a blade which control the toner thickness on a development roller tend to occur.

These are also true in a toner containing a large amount of particles having an excessively small diameter.

In contrast, a toner having a volume-average particle diameter exceeding 8 μm may not yield high-quality images with high resolution. In addition, variation of the toner particle diameter becomes large since the toner is repeatedly consumed and supplied to adjust the toner amount with respect to the carrier in the developing device during development. This is also true if the ratio Dv/Dn of the volume-average particle diameter Dv to the number-average particle diameter Dn exceeds 1.25.

The present inventors have also found that a toner having a ratio Dv/Dn of less than 1.10 may not be charged sufficiently or may not be cleaned satisfactorily, although it behaves stably and is charged uniformly.

Toner Composition

Binder Resins

Binder resins for use in the toner of the present invention include, but are not limited to, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly (methyl methacrylate), poly(butyl methacrylate), poly(vinyl chloride), poly(vinyl acetate), polyethylenes, polypropylenes, polyesters, epoxy resins, polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination. Among them, polyester resins and polyol resins are preferred.

Polyester resins are also preferably used as the binder resin. Such polyester resins can be any polyester resins but are preferably polyester resins prepared as a result of the reaction among the following components (1), (2) and (3):

(1) at least one of dicarboxylic acids, lower alkyl esters and acid anhydrides thereof;

(2) a diol component represented by following Formula 1:

Formula 1

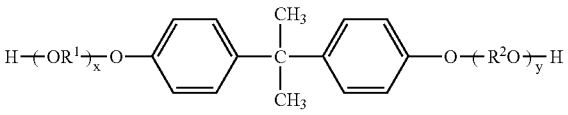

wherein $R^1$ and $R^2$ may be the same or different and are each an alkylene group containing 2 to 4 carbon atoms; x and y are each the number of a repeating unit and are each 1 or more, and x+y is 2 to 16; and (3) at least one selected from trivalent or higher polycarboxylic acids, lower alkyl esters and acid anhydrides thereof, and trihydric or higher polyhydric alcohols.

Examples of the component (1), i.e., dicarboxylic acids, lower alkyl esters and acid anhydrides thereof, are terephthalic acid, isophthalic acid, sebacic acid, isodecylsuccinic acid, maleic acid, and fumaric acid; monomethyl, monoethyl, dimethyl, and diethyl esters of these carboxylic acids; phthalic anhydride, and maleic anhydride. Among them, terephthalic acid, isophthalic acid, and dimethyl esters thereof are preferred for higher blocking resistance and lower cost. These dicarboxylic acids, lower alkyl esters and acid anhydrides thereof largely affect the image-fixing properties and blocking resistance of the toner. While depending on the degree of condensation, the use of an aromatic carboxylic acid such as terephthalic acid or isophthalic acid in a large amount decreases the image-fixing properties although it increases the blocking resistance. In contrast, the use of sebacic acid, isodecylsuccinic acid, maleic acid, or fumaric acid in a large amount decreases the blocking resistance although it increases the image-fixing properties. These dicarboxylic acids and derivatives thereof should be appropriately selected and used alone or in combination depending on the composition of the other monomers, proportions thereof, and degree of condensation.

Examples of the diol component (2) represented by Formula 1 are polyoxypropylene-(n)-polyoxyethylene-(n')-2,2-bis(4-hydro xyphenyl)propane, polyoxypropylene-(n)-2,2-bis(4-hydroxyphenyl)propane, and polyoxyethylene-(n)-2,2-bis(4-hydroxyphenyl)propane.

Among them, preferred are polyoxypropylene-(n)-2,2-bis(4-hydroxyphenyl)propane where "n" is 2.1 or more and 2.5 or less, and polyoxyethylene-(n)-2,2-bis(4-hydroxyphenyl)propane where "n" is 2.0 or more and 2.5 or less. These diol components serve to increase the glass transition temperature and to control the reaction more easily.

As the diol component, ethylene glycol, diethylene glycol, 1,2-butanediol, 1,3-butanediol, 1,4-butanediol, neopentyl glycol, propylene glycol, and other aliphatic diols can also be used.

Of the components (3), the trivalent or higher polycarboxylic acids, lower alkyl esters and acid anhydrides thereof include, for example, 1,2,4-benzenetricarboxylic acid (trimellitic acid), 1,3,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy) methane, 1,2,7,8-octanetetracarboxylic acid, empol trimer acid, and monomethyl, monoethyl, dimethyl, and diethyl esters of these polycarboxylic acids.

Examples of the trihydric or higher polyhydric alcohols as the components (3) are sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

The amount of the trivalent or higher polyvalent monomers is preferably 1% by mole to 30% by mole based on the total amount of the monomer composition. If the amount is less than 1% by mole, the toner may have decreased anti-offset performance and deteriorated durability. If it is more than 30% by mole, the toner may have deteriorated image-fixing properties.

Among these trivalent or higher polyvalent monomers, benzenetricarboxylic acids, anhydrides, esters, and other derivatives thereof are preferred. By using the benzenetricarboxylic acids or derivatives thereof, the toner can have both satisfactory image-fixing properties and high anti-offset performance.

These binder resins can be prepared according to any procedure such as bulk polymerization, solution polymerization, emulsion polymerization, and suspension polymerization.

The crosslinked polymer in the toner may have a crosslinked structure in which vinyl polymer units in the binder resin are crosslinked with a crosslinking agent having two or more vinyl groups. Examples of the crosslinking agent used herein are aromatic vinyl compounds such as divinylbenzene and divinylnaphthalene; di(meth)acrylate compounds combined through an alkyl chain, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and dimethacrylate compounds corresponding to these diacrylate compounds; di(meth)acrylate compounds combined through an alkyl chain containing an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and dimethacrylate compounds corresponding to these diacrylate compounds; di(meth)acrylate compounds combined through a chain containing an aromatic group and an ether bond, such as polyoxyethylene (2)-2,2-bis(4-hydroxydiphenyl)propane diacrylate, polyoxyethylene (4)-2,2-bis(4-hydroxydiphenyl)propane diacrylate, and dimethacrylate compounds corresponding to these diacrylate compounds; and polyester diacrylates such as MANDA (trade name, available from Nippon Kayaku Co., Ltd.).

Examples of polyfunctional crosslinking agents are pentaerythritol triacrylate, trimethylolethane triacrylate, trimethylolpropane triacrylate, tetramethylolmethane tetraacrylate, oligo ester acrylate, and methacrylate compounds corresponding to these acrylate compounds; as well as triallyl cyanurate and triallyl trimellitate.

The amount of the crosslinking agent(s) is preferably from 0.01 parts by weight to 10.0 parts by weight and more preferably from 0.03 parts by weight to 5 parts by weight to 100 parts by weight of other monomer components.

Among these crosslinkable monomers, preferred monomers for use in the binder resin are aromatic divinyl compounds such as divinylbenzene and di(meth)acrylate compounds combined through a chain having an aromatic group and an ether bond, for satisfactory image fixing properties and offset resistance.

The vinyl copolymer component and/or polyester resin component preferably contains a monomer component that is reactive with the two resin components. Examples of monomers to constitute the polyester resin component which are reactive with vinyl copolymers are fumaric acid, maleic acid, citraconic acid, itaconic acid and other unsaturated dicarboxylic acids or anhydrides thereof. Examples of monomers to constitute the vinyl copolymer component which are reactive with the polyester resin component are monomers having carboxyl group or hydroxyl group, as well as acrylic or methacrylic esters.

Colorants

Any conventional or known dyes and pigments can be used as the colorant for the toner of the present invention. Such dyes and pigments include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof. The amount of the colorant is generally from about 0.1 parts by weight to about 50 parts by weight relative to 100 parts by weight of the binder resin.

Master Batch Pigments

A colorant for use in the present invention may be a master batch pigment prepared by mixing and kneading a pigment with a resin in nearly equal proportions to thereby improve miscibility (compatibility) of the resin and the pigment. More preferably, a master batch pigment having excellent electrostatic stability even under severe conditions can be prepared by heating and kneading the pigment and a resin containing fractions soluble in a low polar solvent without the use of an organic solvent. The dispersibility of the master batch pigment can be further improved by using a dry powder pigment as the pigment and using water to yield wettability with the resin. An organic pigment used as a colorant is generally hydrophobic, but water can enter the inside of the aggregate by applying some force, since the organic pigment has been subjected to washing with water and drying processes during its production.

When the pigment containing water inside its aggregate is kneaded with a resin in an open kneader at a set temperature of 100° C. or higher, water inside the aggregate reaches its boiling point momentarily and expands, thus causing force to crush the aggregate from inside thereof. The force from inside the aggregate can much more efficiently crush the aggregate than external force. The resin in this state is heated to a temperature higher than its softening point, has thereby a decreased viscosity and can efficiently wet the aggregate. In addition, the resin replaces the water heated at a temperature around its boiling point inside the aggregate due to an effect similar to "flashing". The resulting master batch pigment contains the pigment substantially dispersed in the form of primary particles.

During its vaporization, the water deprives the kneaded product of the heat of vaporization, and the kneaded product is held at a relatively low temperature of 100° C. or lower at relatively high viscosity. Thus, shearing force is effectively applied to the aggregate of the pigment. Open kneaders for use in the production of the master batch pigment include regular two-roll kneaders, three-roll kneaders, as well as open-type Banbury mixers, and continuous two-roll kneaders available from Mitsui Mining Co., Ltd.

Charge Control Agents

The toner of the present invention may further comprise a charge control agent according to necessity. Such charge control agents for use in the present invention include known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the binder resin, additives, if any, used according to necessity, and the method for preparing the toner including a dispersing process and is preferably from 0.1 parts by weight to 10 parts by weight, and more preferably from 2 parts by weight to 5 parts by weight, relative to 100 parts by weight of the binder resin. If the amount is more than 10 parts by weight, the toner may have excessively high charges, the charge control agent may not sufficiently play its role, the developer may have increased electrostatic attraction to a development roller, may have decreased fluidity or may induce decreased concentration of images.

Wax (Releasing agents)

The toner or developer preferably comprises wax as a releasing agent to thereby have good releasability in image-fixing procedure. In particular, when an oilless fixing device which does not use oil in an image-fixing unit is employed, the toner specifically preferably comprises a wax. The wax has a melting point of preferably from 40° C. to 120° C. and more preferably from 50° C. to 110° C. If the wax has an excessively high melting point, the toner may have insufficient image-fixing properties at low temperatures. If the wax has an excessively low melting point, the toner may have decreased anti-offset performance and durability. The melting point of the wax can be determined by differential scanning calorimetry (DSC). More specifically, a sample of several milligrams is heated at a constant heating rate, such as 10° C./min, and the melting peak obtained in this procedure is defined as the melting point. The content of the wax is preferably from 0 to 20 parts by weight, and more preferably from 0 to 10 parts by weight relative to 100 parts by weight of the toner.

Such wax for use in the present invention include, but are not limited to, solid paraffin wax, microcrystalline wax, rice wax, fatty acid amide wax, fatty acid wax, aliphatic monoketones, fatty acid metal salt wax, fatty acid ester wax, partially saponified fatty acid ester wax, silicone varnish, higher alcohols, and carnauba wax. In addition, low molecular weight polyethylenes, polypropylenes, and other polyolefins can be used as the wax component. Among them, polyolefins and esters having a softening point of 60° C. to 150° C., and more preferably 70° C. to 120° C. as determined by a ball and ring method are preferred.

The toner more preferably comprises at least one wax selected from free-fatty-acid-free type carnauba wax having an acid value of 5 mgKOH/g or less, montan ester wax, oxidized rice wax having an acid value of 10 mgKOH/g to 30 mgKOH/g, and Sasol Wax. Such free-fatty-acid-free type carnauba wax is prepared by removing free fatty acids from material carnauba wax and have an acid value of 5 mgKOH/g or less. These treated carnauba wax contains crystals having a smaller particle diameter than conventional carnauba wax and can be dispersed in the form of fine particles having an average particle diameter of 1 μm or less in the binder resin. The montan ester wax are purified from minerals, have a smaller particle diameter and can be dispersed in the form of fine particles having an average particle diameter of 1 μm or less into the binder resin as in the treated carnauba wax. The montan ester wax preferably has an acid value of 5 mgKOH/g to 14 mgKOH/g.

The dispersed particles of the wax in the toner have a diameter of preferably 3 μm or less, more preferably 2 μm or less, and further preferably 1 μm or less. When the dispersed particles have a diameter exceeding 3 μm, the resulting toner may have deteriorated durability at high temperatures and high humidity and decreased charging stability, although the wax flowability and releasability of the transfer medium increase.

The oxidized rice wax is prepared by oxidizing rice bran wax with the air. The oxidized rice wax preferably has an acid value of 10 mgKOH/g to 30 mgKOH/g. If the acid value is less than 10 mgKOH/g, the lower limit temperature of image fixing may increase to thereby deteriorate image-fixing properties at low temperatures. If it is more than 30 mgKOH/g, the cold-offset temperature may increase to thereby deteriorate image-fixing properties at low temperatures. Examples of the Sasol Wax is commercially available under the trade names of Sasol Wax H1, H2, A1, A2, A3, A4, A6, A7, A14, C1, C2, SPRAY30, and SPRAY40 available from Sasol. Among them, Sasol Wax H1, H2, SPRAY30, and SPRAY 40 are preferred for their high image-fixing properties at low temperatures and high storage stability. Each of the wax can be used alone or in combination. By using the wax in an amount of from 1 part by weight to 15 parts by weight and preferably from 2 parts by weight to 10 parts by weight relative to 100 parts by weight of the binder resin, the aforementioned advantages can be obtained.

External Additives

Hydrophobed inorganic fine particles can be used in combination with inorganic fine particles as the external additive. The hydrophobed inorganic fine particles have an average particle diameter of primary particles of preferably 1 nm to 100 nm and more preferably 5 nm to 70 nm. These fine particles preferably have a specific surface area of 20 $m^2/g$ to 500 $m^2/g$ as determined according to the Brunauer-Emmett-Teller (BET) method.

Any of known fine particles can be used herein as long as they satisfy the requirements. For example, the external additive can comprise any of silica fine particles; hydrophobic silica; fatty acid metallic salts such as zinc stearate and aluminium stearate; metallic oxides such as titania, alumina, tin oxide, and antimony oxide; and fluoropolymers.

Among them, fine particles of hydrophobed silica, titania, titanium oxide, and aluminum are preferred as external additives. Such silica fine particles are commercially available under the trade names of HDK H 2000, HDK H 2000/4, HDK H 2050EP, HVK21, and HDK H 1303 from Clariant Japan Co., Ltd.; and R972, R974, RX200, RY200, R202, R805, and R812 from Nippon Aerosil Co., Ltd.

Titania fine particles are commercially available under the trade names of P-25 from Nippon Aerosil Co., Ltd.; STT-30 and STT-65C-S from Titan Kogyo Kabushiki Kaisha; TAF-140 from FUJI TITANIUM INDUSTRY CO., LTD.; and MT-150W, MT-500B, MT-600B, and MT-150A from TAYCA Corporation. Hydrophobed titanium oxide fine particles are commercially available under the trade names of T-805 from Nippon Aerosil Co., Ltd.; STT-30A, and STT-65S-S from Titan Kogyo Kabushiki Kaisha; TAF-500T, and TAF-1500T from FUJI TITANIUM INDUSTRY CO., LTD.; MT-100S, and MT-100T from TAYCA Corporation; and IT-S from Ishihara Sangyo Kaisha, Ltd.

Such inorganic fine particles, silica fine particles, titania fine particles, and alumina fine particles can be obtained by treating hydrophilic material fine particles with a silane coupling agent. Such silane coupling agents include, for example, methyltrimethoxysilane, methyltriethoxysilane, and octyltrimethoxysilane. In addition, silicone oil-treated oxide fine particles and inorganic fine particles are also preferred. Such treated fine particles are prepared by treating material fine particles with silicon oil, where necessary while heating.

Such silicone oils include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic or methacrylic-modified silicone oils, and α-methylstyrene-modified silicone oils.

Examples of the inorganic fine particles are fine particles of silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride. Among them, silica and titanium dioxide fine particles are preferred. The amount of the additive is preferably 0.1% by weight to 5% by weight, and more preferably 0.3% by weight to 3% by weight based on the total weight of the toner. The inorganic fine particles should preferably have an average particle diameter of primary particles of 100 nm or less, and more preferably 3 nm or more and 70 nm or less. If the average particle diameter is less than this range, the inorganic fine particles are embedded in the toner to thereby fail to exhibit their functions effectively. If it exceeds the above-mentioned range, the particles may heterogeneously damage the surface of the photoconductor.

Coupling Agents

Examples of coupling agents (surface treatment agents) for the external additives including oxide fine particles are dialkyldihalogenosilanes, trialkylhalogenosilanes, alkyltrihalogenosilanes, hexaalkyldisilazanes, and other silane coupling agents; sililating agents; silane coupling agents having a fluoroalkyl group; organotitanate coupling agents; aluminum coupling agents; silicone oils; and silicone varnish. Among them, organosilicon compound coupling agents and hydrophobing agents are preferred.

Manufacturing Process

The toner of the present invention can be produced by a process including the steps of: mechanically mixing a developer composition containing a binder resin, a main charge control agent and a pigment (colorant); melting and kneading the resulting mixture; pulverizing the kneaded article; and classifying the pulverized article. The manufacturing process may further comprise the step of recycling other powders than product particles obtained in the pulverizing step or in the classifying step, to the step of mechanically mixing or the step of melting and kneading.

The term "the other powders (by-products) than the product particles" as used herein means fine particles or crude particles other than the product component having a set particle diameter obtained in the pulverizing step after the melting and kneading step, or fine particles or crude particles other than the product component having a set particle diameter obtained in the subsequent classifying step. These by-products are preferably mixed with the raw materials in the mixing step or in the melting and kneading step. The weight ratio of the by-products to the raw materials is preferably 1:99 to 50:50.

In the mixing step, the developer composition containing the binder resin, the main charge control agent, the pigment and the by-products, if any, can be mechanically mixed using a regular mixer such as one with a rotating blade under any conditions. More preferably, the resin and the colorant have been mixed in advance.

After the completion of the mixing step, the resulting mixture is charged into a kneader and is melted and kneaded therein. Such melting kneaders include, for example, single-screw or twin-screw continuous kneaders, and roll-mill batch-system kneaders. These kneaders are commercially available, for example, as a twin-screw extruder Model KTK from Kobe Steel Co., Ltd., a TEM series co-rotating twin-screw compounder from TOSHIBA MACHINE Co., Ltd., a twin-screw extruder from KCK Tool & Die, Co., a twin-screw extruder Model PCM from Ikegai, Ltd., and a co-kneader from Buss Co., Ltd.

The melting and kneading step must be performed under appropriate conditions so as not to cause cleavage of molecular chains of the binder resin. More specifically, the melting and kneading temperature should be set in consideration of the softening point of the binder resin. If it is excessively lower than the softening point, the molecular chains of the binder resin are significantly cleaved. In contrast, if it is excessively higher than the softening point, the components may not be sufficiently dispersed. To control the amount of volatile components in the toner, it is preferable to set optimum conditions of the temperature, time, and atmosphere of the melting and kneading step while monitoring the amount of residual volatile components.

After the compression of the melting and kneading step, the resulting kneaded product is pulverized. In the pulverizing step, it is preferred that the kneaded product is roughly pulverized and then the roughly pulverized article is finely pulverized. Such pulverization is preferably performed according to a collision pulverization method in which the article is allowed to collide with a breaker disc in a jet stream to be pulverized or a method in which the article is pulverized in a narrow gap between a mechanically rotating rotor and a stator.

After the completion of the pulverizing step, the pulverized product is classified in a gas stream by action of, for example, centrifugal force to thereby yield toner particles (base particles) having a set particle diameter such as a volume-average particle diameter of 2 μm to 7 μm. The toner particles have a volume-average particle diameter of preferably 2 μm to 8 μm and more preferably 4 μm to 8 μm for better image quality, lower production cost and satisfactory coverage with the external additive. The volume-average particle diameter can be determined using, for example, an instrument COULTER TA-II available from Coulter Electronics, Inc.

To further improve the fluidity, storage stability, developing properties, and transfer properties of the toner, the aforementioned oxide fine particles, hydrophobic silica fine particles, and other inorganic fine particles may be added to the above-prepared toner. These external additives can be mixed with the toner particles using a regular mixer for powders. The mixer for use herein preferably has a jacket or another unit to control its inner temperature. To change the hysteresis of a load applied to the external additive, the external additive may be added in the course of the mixing process or sequentially during the mixing process. Alternatively, the number of revolutions, the speed of tumbling, time period, and temperature of the mixer can be changed to change the hysteresis of the load. It is acceptable that a relatively high load is applied at early stages, and a relatively low load is then applied, or they can be applied in a retrograde order.

Examples of mixing systems for use herein are V mixers, rocking mixers, Ledige mixers, nauta mixers, and Henshel mixers. The toner can also be prepared by a polymerization method or a capsulation method. These methods will be schematically illustrated below. The preparation of the toner is not specifically limited to these examples.

Polymerization Method 1

(1) A polymerizable monomer, and where necessary a polymerization initiator, a colorant, wax and other components are granulated in a water-based disperse medium.

(2) The granulated monomer composition particles are classified into an appropriate particle diameter.

(3) The monomer composition particles having a specific particle diameter are polymerized.

(4) The dispersing agent (dispersion medium) is removed by an appropriate treatment, and the resulting polymerization product is subjected to filtration, washing with water, and drying to thereby yield base particles.

Capsulation Method (1) A resin, and a colorant and other necessary components are kneaded, for example, using a kneader to thereby yield a molten toner core.

(2) The toner core is placed in water and is strongly stirred to thereby yield core fine particles.

(3) The core fine particles are placed in a solution of a shell material, is stirred and is treated with a poor solvent added dropwise to cover the surface of the core with the shell material to thereby form capsules.

(4) The capsules are filtrated and dried to thereby yield base particles.

Process Cartridge

FIG. 1 shows a schematic diagram showing an example of an image forming apparatus having a process cartridge housing the toner of the present invention.

The process cartridge 10 according to the present invention comprises a photoconductor 11 as a latent electrostatic image bearing member and at least one of a charging unit 12, a developing unit 13 and a cleaning unit 14. The process cartridge 10 is so configured as to be attachable to and detachable from a main body of an image forming apparatus such as a copier or a printer.

Image Forming Apparatus

In the image forming apparatus having the process cartridge of the present invention, the photoconductor served as a latent electrostatic image bearing member, is rotated at a predetermined peripheral velocity. During the cycle of a rotation of the photoconductor, the charging unit uniformly charges the photoconductor at a predetermined positive or negative potential, thereafter an exposing unit such as slit exposure or laser beam scanning exposure, applies light imagewise to the charged photoconductor. In this way, latent electrostatic images are sequentially formed on the circumference surface of the photoconductor. As follow, the developing unit develops the formed latent electrostatic images with the toner so as to form toner images, and then a transfer unit sequentially transfers the toner images onto a transfer medium which is fed from a paper feeder to between the photoconductor and the transfer device synchronously with the rotation of the photoconductor. The transfer medium bearing the transferred toner image is separated from the photoconductor and is introduced to the fixing unit. The fixing unit fixes the transferred image onto the transfer medium so as to form a reproduction (copy) and then the copy is sent out from the apparatus, i.e., printed out. After transferring the toner image, the cleaner served as a cleaning unit removes the remained toner onto the surface of the photoconductor so as to clean the surface. The photoconductor is then destaticized so as to be ready for another image formation.

Charging unit

Roller Charger

Figure 2:
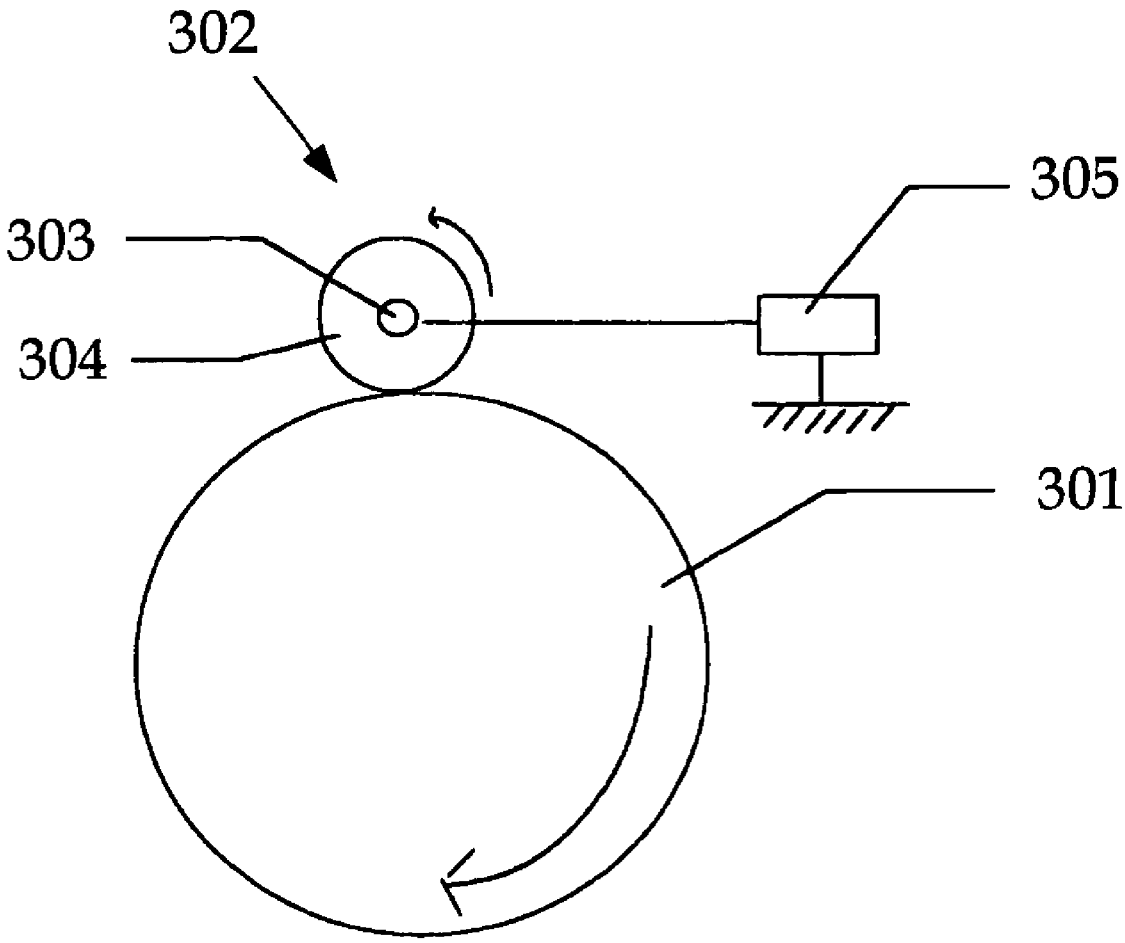
FIG. 2 is a schematic diagram showing an example of a contact charger (roller) for use in the present invention.

FIG. 2 is a schematic diagram showing an example of the image-forming apparatus that equips a contact charger (charging unit). The photoconductor 301 to be charged as a latent electrostatic image bearing member is rotated at a predetermined speed (process speed) in the direction shown with the arrow in the figure. The charging roller 302, which is brought into contact with the photoconductor, contains a core rod 303 and a conductive rubber layer 304 formed on the core rod in a shape of a concentric circle. The both terminals of the core rod 303 are supported with bearings (not shown) so that the charging roller enables to rotate freely, and the charging roller is pressed to the photoconductor at a predetermined pressure by a pressurizing member (not shown). The charging roller 302 in this figure therefore rotates along with the rotation of the photoconductor. The charging roller 302 is generally formed with a diameter of 16 mm in which a core rod having a diameter of 9 mm is coated with a rubber layer having a moderate resistance of approximately 100,000 Ω·cm.

The power supply 305 shown in the figure is electrically connected with the core rod 303, and a predetermined bias is applied to the charging roller 302 by the power supply. Thus, the surface of the photoconductor 301 is uniformly charged at a predetermined polarity and potential.

As a charging unit for use in the present invention, the shape thereof is not specifically limited and can for example be, apart from a roller, a magnetic brush or a fur brush. It can be suitably selected according to a specification or configuration of an image-forming apparatus. When a magnetic brush is used as a charger, the magnetic brush contains an electrostatic charger formed of various ferrite particles such as Zn—Cu ferrite, a non-magnetic conductive sleeve to support the electrostatic charger, and a magnetic roller contained in the non-magnetic conductive sleeve. When a fur brush is used as a charger, a material of the fur brush is, for example, a fur that becomes conductive by treatment with, for example, carbon, copper sulfide, a metal or a metal oxide, and the fur is coiled or mounted to a metal or another core rod which becomes conductive by treatment.

Fur Brush Charger

Figure 3:
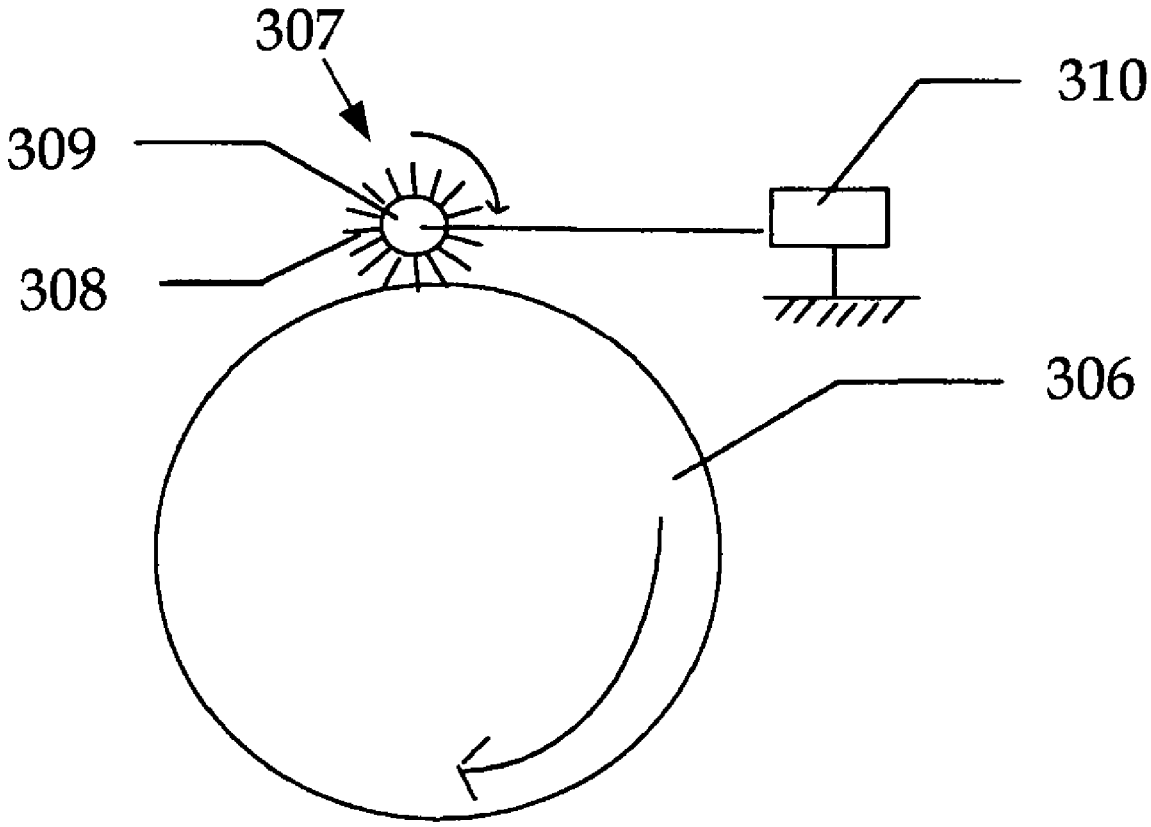
FIG. 3 is a schematic diagram showing an example of a contact charger (brush) for use in the present invention.

FIG. 3 is a schematic diagram of another example of the image-forming apparatus that equips a contact charger (charging unit). The photoconductor 306 as an object to be charged and a latent electrostatic image bearing member, is rotated at a predetermined speed (process speed) in the direction shown with the arrow in the figure. The brush roller 307 having a fur brush is brought in contact with the photoconductor 306, with a predetermined nip width and a predetermined pressure with respect to elasticity of the brush part 308.

The fur brush roller 307 as the contact charger (charging unit) used in the present invention has an outside diameter of 14 mm and a longitudinal length of 250 mm. In this fur brush, a tape with a pile of conductive rayon fiber REC-B (trade name, available from Unitika Ltd.), as a brush part 308, is spirally coiled around a metal core rod 309 having a diameter of 6 mm, which is also functioned as an electrode. The brush of the brush part 308 is of 300 denier/50 filament, and a density of 151 fibers per 1 square millimeter. This role brush is once inserted into a pipe having an internal diameter of 12 mm with rotating in a certain direction, and is set so as to be a concentric circle relative to the pipe. Thereafter, the role brush in the pipe is left in an atmosphere of high humidity and high temperature so as to twist the fibers of the fur.

The resistance of the fur brush roller 307 is $1\times10^5$ Ω at an applied voltage of 100 V. This resistance is calculated from the current obtained when the fur brush rolled is contacted with a metal drum having a diameter of 30 mm with a nip width of 3 mm, and a voltage of 100 V is applied thereon.

The resistance of the fur brush roller should be $10^4$ Ω or more in order to prevent image imperfection caused by an insufficient charge at the charging nip part when the photoconductor to be charged happens to have low electric strength defects such as pin holes thereon and an excessive leak current therefore runs into the defects. Moreover, it should be $10^7$ Ω or less in order to sufficiently charge the surface of the photoconductor.

Examples of the material of the fur include, in addition to REC-B (trade name, available from Unitika Ltd.), REC-C, REC-M1, REC-M10 (trade names, available from Unitika Ltd.), SA-7 (trade name, available from Toray Industries, Inc.), Thunderon (trade name, available from Nihon Sanmo Dyeing Co., Ltd.), Beltron (trade name, available from Kanebo Gohsen, Ltd.), Kuracarbo in which carbon is dispersed in rayon (trade name, available from Kuraray Co., Ltd.), and Roval (trade name, available from Mitsubishi Rayon Co., Ltd.). The brush is of preferably 3 to 10 denier per fiber, 10 to 100 filaments per bundle, and 80 to 600 fibers per square millimeter. The length of the fur is preferably 1 mm to 10 mm.

The fur brush roller 307 is rotated in the opposite (counter) direction to the rotation direction of the photoconductor at a predetermined peripheral velocity, and comes into contact with the photoconductor with a velocity deference. The power supply 310 applies a predetermined charging voltage to the fur brush roller so that the surface of the photoconductor is uniformly charged at a predetermined polarity and potential. In contact charge of the photoconductor 306 by the fur brush roller 307 of the present embodiment, charges are mainly directly injected and the surface of the photoconductor is charged at the substantially equal voltage to the applying charging voltage to the fur brush roller 307.

The electrostatic charger for use in the present invention as a charging unit is not specifically limited in its shape and can be, for example, a charging roller or magnetic fur blush, as well as a fur blush roller. The shape can be selected according to the specification and configuration of the image forming apparatus. When a charging roller is used, it generally comprises a core rod and a rubber layer of moderate resistance of about 100,000 Ω·cm coated on the core rod. When a magnetic fur blush is used, it generally comprises, for example, particles of ferrite such as Zn Cu ferrite as an electrostatic charging member, a non magnetic conductive sleeve supporting the ferrite particles, and a magnet roll included in the conductive sleeve.

Magnetic Brush Charger

FIG. 3 is a schematic diagram showing one example of the image-forming apparatus that equips a contact charger (charging unit). The photoconductor as an object to be charged and served as a latent electrostatic image bearing member is rotated at a predetermined speed (process speed) in the direction shown with the arrow in the figure. The brush roller having a magnetic brush is brought in contact with the photoconductor, with a predetermined nip width and a predetermined pressure with respect to elasticity of the brush part.

The magnetic brush as a contact charger of the present embodiment is formed of magnetic particles. In the magnetic particles, Z—Cu ferrite particles having an average particle diameter of 25 μm and Z—Cu ferrite particles having an average particle diameter of 10 μm are mixed in a ratio of 1/0.05 so as to form ferrite particles having peaks at each average particle diameter, and a total average particle diameter of 25 μm. The ferrite particles are coated with a resin layer having a moderate resistance so as to form the magnetic particles. The contact charger of this embodiment formed from the above-mentioned coated magnetic particles, a non-magnetic conductive sleeve which supports the coated magnetic particles, and a magnet roller which is included in the non-magnetic conductive sleeve. The coated magnetic particles are disposed on the sleeve with a thickness of 1 mm so as to form a charging nip 5 mm wide with the photoconductor. The width between the non-magnetic conductive sleeve and the photoconductor is adjusted to approximately 500 μm. The magnetic roller is rotated so as to subject the non-magnetic conductive sleeve to rotate at twice in speed relative to the peripheral speed of the surface of the photoconductor, and in the opposite direction with the photoconductor. Therefore, the magnetic brush is uniformly in contact with the photoconductor.

As a charging unit for use in the present invention, the shape thereof is not specifically limited and can for example be, apart from a magnetic brush, a charging roller or a fur brush. It can be suitably selected according to a specification or configuration of an image forming apparatus. When a charging roller is used, it generally comprises a core rod and a rubber layer of moderate resistance of about 100,000 Ω·cm coated on the core rod. When a fur brush is used as a charging unit, a material of the fur brush is, for example, a fur that becomes conductive by treatment with, for example, carbon, copper sulfide, a metal or a metal oxide, and the fur is coiled or mounted to a metal or another core rod which becomes conductive by treatment.

Jumping Development

Figure 4:
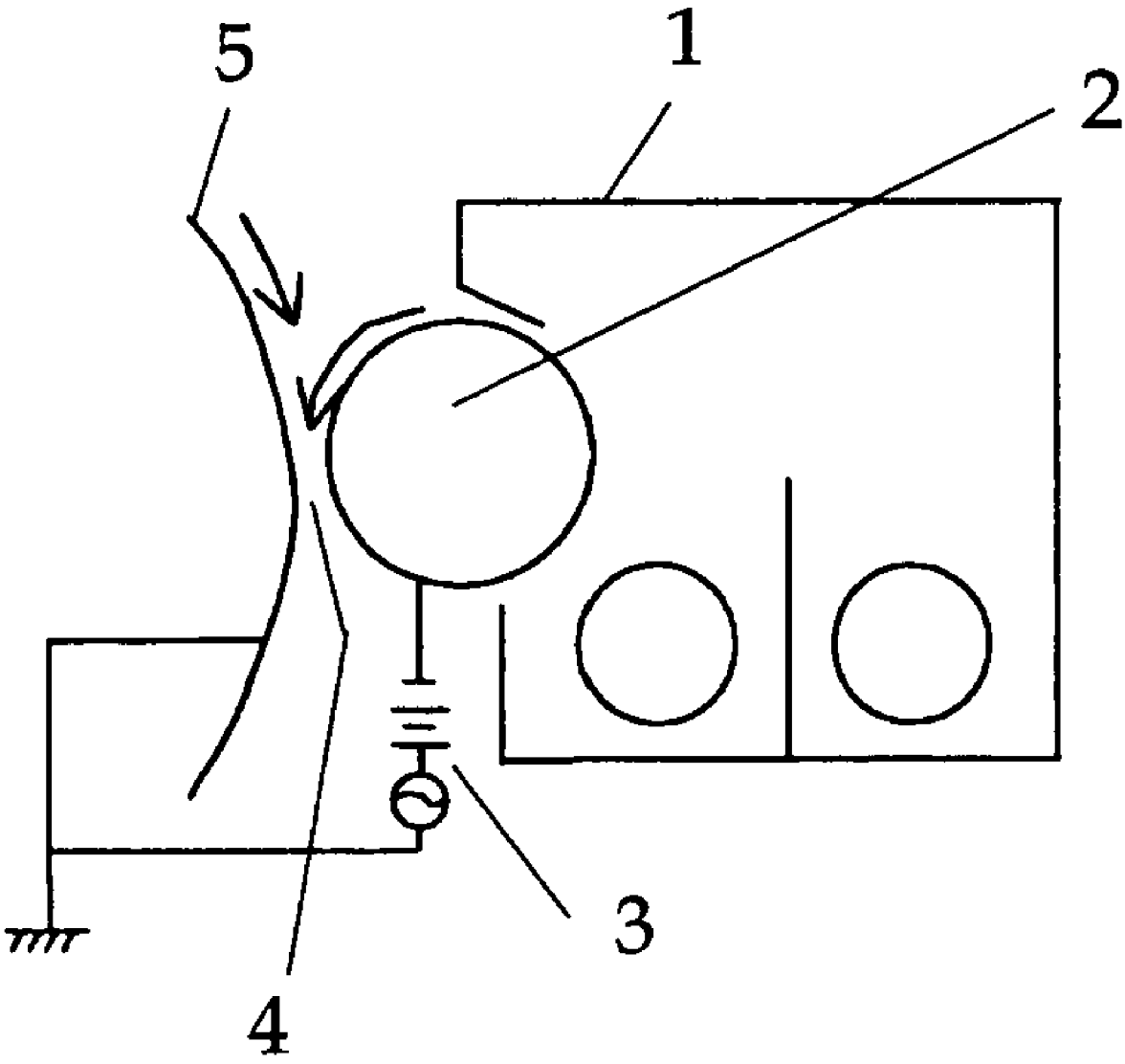
FIG. 4 is a schematic diagram showing an example of a jumping developing unit for use in the present invention.

In an image developing device (developing unit) 1 according to the present embodiment shown in FIG. 4, a power supply 3 applies a vibration bias voltage as developing bias, in which a direct-current voltage and an alternating voltage are superimposed, to a developing sleeve 2 during development. The potential of background part and the potential of image part are positioned between the maximum and the minimum of the vibration bias potential. This forms an alternating field, whose direction alternately changes, at developing region 4. A toner and a carrier in the developer are intensively vibrated in this alternating field, so that the toner overshoots the electrostatic force of constraint from the developing sleeve 2 and the carrier, and leaps to the photoconductor drum 5 served as a latent electrostatic image bearing member. The toner is then attached to the photoconductor drum 5 in accordance with a latent electrostatic image thereon.

The difference between the maximum and the minimum of the vibration bias voltage (peak-to-peak voltage) is preferably from 0.5 kV to 5 kV, and the frequency is preferably from 1 kHz to 10 kHz. The waveform of the vibration bias voltage may be a rectangular wave, a sine wave or a triangular wave. The direct-current voltage of the vibration bias voltage is in a range between the potential at the background and the potential at the image as mentioned above, and is preferably set closer to the potential at the background from viewpoints of inhibiting a toner deposition on the background.

When the vibration bias voltage is a rectangular wave, it is preferred that a duty ratio is 50% or less. The duty ratio is a ratio of time when the toner leaps to the photoconductor during a cycle of the vibration bias. In this way, the difference between the peak time value when the toner leaps to the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier having an opposite polarity of current to the toner leaps to the photoconductor and the time average value of bias can be decreased. Consequently the movement of the carrier can be restrained and the possibility of the carrier deposition on the background is largely reduced.

Amorphous Silicon Photoconductor

In the present invention, an amorphous silicon photoconductor is used as a latent electrostatic image bearing member. The amorphous silicon photoconductor (hereinafter referred to as a-Si photoconductor) has an electrically conductive substrate and a photoconductive layer formed of a-Si. The a-Si photoconductor can be prepared by heating the electrically conductive substrate at 50° C. to 400° C. and forming a film of amorphous silicone by a film forming process such as vacuum deposition, sputtering, ion-plating, thermal CVD, optical CVD or plasma CVD. Of these, preferable method is plasma CVD in which raw material gas is decomposed by glow discharge of direct current, high frequency or microwave, and then a-Si is deposited on the substrate so as to form an a-Si film.

Layer Structure

Figure 5A:
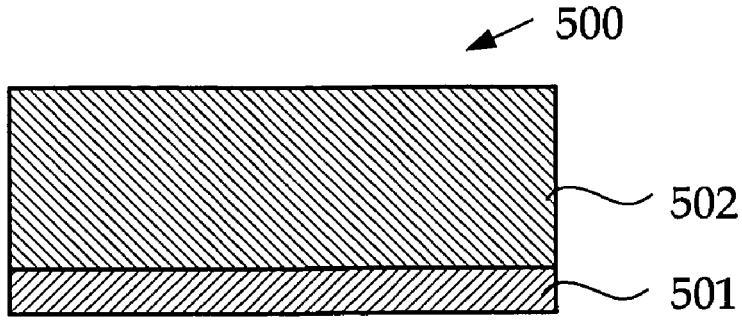
FIGS. 5A, 5B, 5C and 5D are each a schematic diagram showing an example of a layer configuration of an amorphous photoconductor for use in the present invention.
Figure 5B:
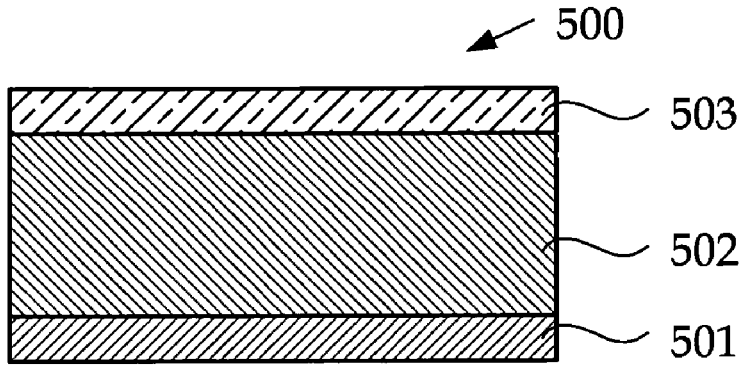
Figure 5C:
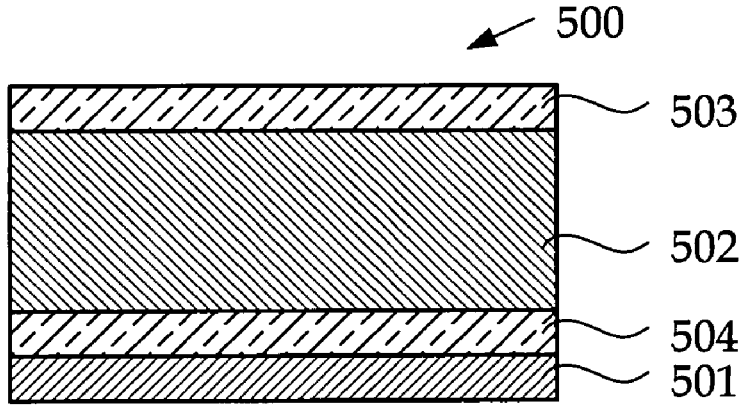
Figure 5D:
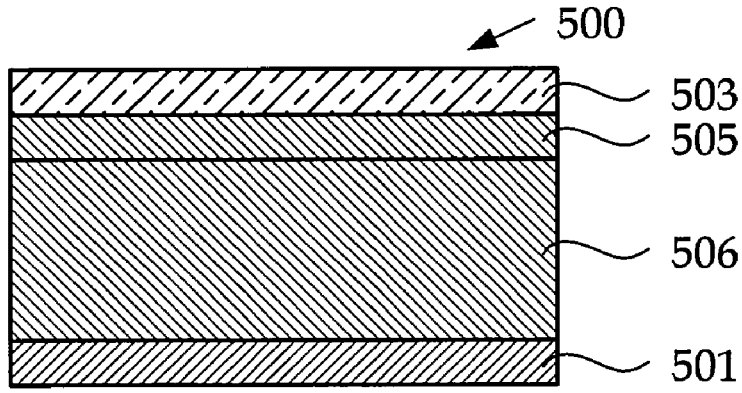

Examples of the layer structure of the amorphous silicon photoconductor are as follows. FIGS. 5A, 5B, 5C and 5D are schematic diagrams which explain the layer structure of the amorphous silicon photoconductor. With reference to FIG. 5A, a photoconductor 500 has a substrate 501 and a photoconductive layer 502 on the substrate 501. The photoconductive layer 502 is formed of a-Si:H, X, and exhibits photoconductivity. With reference to FIG. 5B, a photoconductor 500 has a substrate 501, a photoconductive layer 502 formed of a-Si:H, X and an amorphous silicon surface layer 503 arranged on the substrate 501. With reference to FIG. 5C, a photoconductor 500 has a substrate 501, and on the substrate 501, a photoconductive layer 502 formed of a-Si:H, X, an amorphous silicon surface layer 503 and an amorphous silicon charge injection inhibiting layer 504. With reference to FIG. 5D, a photoconductor 500 has a substrate 501 and a photoconductive layer 502 on the substrate 501. The photoconductive layer 502 comprises a charge generation layer formed of a-Si:H, X 505 and a charge transport layer 506. The photoconductor 500 further has an amorphous silicon surface layer 503 on the photoconductive layer 502.

Substrate

The substrate of the photoconductor may be electrically conductive or insulative. Examples of the conductive substrate include metals such as Al, Cr, Mo, Au, In, Nb, Te, V, Ti, Pt, Pd, and Fe, and alloys thereof such as stainless steel. An insulative substrate in which at least a surface facing to a photoconductive layer is treated to yield conductivity can also be used as the substrate. Examples of such insulative substrates are a film or sheet of a synthetic resin such as a polyester, polyethylene, polycarbonate, cellulose acetate, polypropylene, polyvinyl chloride, polystyrene or polyamide, glass, or ceramic.

The shape of the substrate may be cylindrical, plate, or endless belt, which has a smooth or irregular surface. The thickness of thereof can be adjusted so as to form a predetermined photoconductor. In the case that flexibility is required to the photoconductor, the substrate can be as thinner as possible within ranges efficiently functioning as a substrate. The thickness of the substrate is generally 10 μm or more from the viewpoints of, for example, manufacture, handling, and mechanical strength.

Charge Injection Inhibiting Layer

In the photoconductor used in the present invention, it is effective to dispose a charge injection inhibiting layer between the conductive substrate and the photoconductive layer (FIG. 5C). The charge injection inhibiting layer inhibits a charge injection from the conductive substrate. The charge injection inhibiting layer has a polarity dependency. Namely, when charges of a specific polarity are applied to a free surface of the photoconductor, the charge injection inhibiting layer functions so as to inhibit a current injection from the conductive substrate to the photoconductive layer, and when charges of the opposite polarity are applied, the charge injection inhibiting layer does not function. In order to attain such function, the charge injection inhibiting layer contains relatively larger amounts of atoms which control a conductivity, compared with the photoconductive layer.

The thickness of the charge injection inhibiting layer is preferably about 0.1 μm to about 5 μm, more preferably 0.3 μm to 4 μm, and furthermore preferable 0.5 μm to 3 μm for desired electrophotographic properties and better economical efficiency.

Photoconductive Layer

The photoconductive layer may be disposed above the substrate 501 according to necessity. The thickness of the photoconductive layer 502 is not particularly limited, as long as desired electrophotographic properties and high cost efficiency are obtained. The thickness is preferably about 1 μm to about 100 μm, more preferably 20 μm to 50 μm, and furthermore preferably 23 μm to 45 μm.

Charge Transport Layer

When the photoconductive layer is divided by its functions into plural layers, the charge transport layer mainly functions to transport currents. The charge transport layer comprises at least silicon atoms, carbon atoms, and fluorine atoms as its essential components. If needed, the charge transport layer may further comprise hydrogen atoms and oxygen atoms so that the charge transport layer is formed of a-SiC(H,F,O). Such charge transport layer exhibits desirable photoconductivity, especially charge holding property, charge generating property, and charge transporting property. It is particularly preferable that the charge transport layer contains an oxygen atom.

The thickness of the charge transport layer is suitably adjusted so as to yield desirable electrophotographic property and cost efficiency. The thickness thereof is preferably about 5 μm to about 50 μm, more preferably 10 μm to 40 μm, and the most preferably 20 μm to 30 μm.

Charge Generation Layer

When the photoconductive layers is divided by its functions into plural layers, the charge generation layer mainly functions to generate charges. The charge generation layer contains at least silicon atoms as an essential component and does not substantially contain a carbon atom. If needed, the charge generation layer may further comprise hydrogen atoms so that the charge generation layer is formed of a-Si:H. Such charge generation layer exhibits desirable photoconductivity, especially charge generating property and charge transporting property.

The thickness of the charge generation layer is suitably adjusted so as to yield desirable electrophotographic property and cost efficiency. The thickness thereof is preferably about 0.5 μm to about 15 μm, more preferably 1 μm to 10 μm, and the most preferably 1 μm to 5 μm.

Surface Layer

The amorphous silicon photoconductor for use in the present invention may further contain a surface layer disposed on the photoconductive layer on the substrate as mentioned above. The surface layer is preferably an amorphous silicon layer. The surface layer has a free surface so that desirable properties such as moisture resistance, usability in continuous repeated use, electric strength, stability in operating environment, and durability.

The thickness of the surface layer is generally about 0.01 μm to about 3 μm, preferably 0.05 μm to 2 μm, and more preferably 0.1 μm to 1 μm. If the thickness is less than about 0.01 μm, the surface layer is worn out during usage of the photoconductor. If it is more than about 3 μm, electrophotographic properties are impaired such as an increase of residual charge.

The present invention will be illustrated in further detail with reference to several examples and a comparative example below, which are not intended to limit the scope of the present invention. All parts and percentages below are by weight unless otherwise specified. The determined properties of toners and developers are shown in Table 1. The test machine, the determination methods of properties are mentioned below.

Test Machine

The following test machine was used to determine the properties of images under test.

Test Machine A

Test Machine A was a modified and tuned tandem full-color laser printer IPSiO Color 8000 available from Ricoh Company, Ltd. including four-color non-magnetic two-component developing units and four-color photoconductors, in which an original image-fixing unit was replaced with an oil-less image-fixing unit. Full-color images were printed at a varying printing speed of 20 to 50 A4-sized sheets per minute in a high-speed printing mode.

Determined Properties

1) Toner Deposition on the Background of Images

After outputting 30,000 copies of an image chart in a monochrome mode with an image occupancy of 50% as running output, a test machine was stopped in the course of development of a blank image. A developer on the photoconductor after development was transferred onto a tape. The difference in image density between the transferred tape and an untransferred tape was determined using a Model 938 spectrodensitometer available from X-Rite, Inc. The toner deposition on the background of images was rated as Failure, Fair, Good and Excellent in this order with a decreasing difference in image density.

2) Image-Fixing Properties

Overall image-fixing properties of a tested toner were determined as Excellent, Good, Fair and Failure in this order with decreasing image-fixing properties. A toner with excellent image-fixing properties has an image-fixing temperature with sufficient margin of its lower limit and upper limit within acceptable image-fixing temperatures, does not invite hot offset and cold offset and is resistant to transportation problems such as wraparound and paper jamming.

3) Cleaning Property

An image 40 mm square with 0.85 mg/cm$^2$ of a toner was formed on the photoconductor; after the untransferred image passed through the cleaning unit, the switch of the copier was turned off; the photoconductor was taken out from the copier; a portion on the photoconductor where the image was formed was peeled off onto a transparent tape; the tape was attached to white paper; and the density of the residual toner on the white paper was determined with a Macbeth densitometer available from Gretag-Macbeth GmbH. The difference between the density of a blank transparent tape attached to white paper and the density of the residual toner on the white paper was calculated, based on which the cleaning property was evaluated according to the following criteria:

Excellent: 0.02 or less

Good: 0.03 to 0.04

Fair: 0.05 to 0.07

Failure: 0.08 or more

Evaluation on Two-component Developer

A two-component developer for use as a test sample was prepared by homogeneously mixing 100 parts by weight of a carrier and 5 parts by weight of a toner of each color in a TURBULA mixer of a type in which the case tumbles to agitate the content and thereby charges the toner. The carrier used herein was a ferrite carrier prepared by the following method, had a weight-average particle diameter of 35 μm and was coated with a silicone resin layer having an average thickness of 0.3 μm.

Preparation of Carrier

| | | |
|---|---|---|
| Core Material | Cu—Zn ferrite particles (weight-average particle diameter: 35 μm) | 5000 parts |
| Coating Material | Toluene | 450 parts |
| | Silicone resin SR 2400 (Dow Corning Toray Silicone Co. Ltd., nonvolatile content: 50%) | 450 parts |
| | Aminosilane SH 6020 (Dow Corning Toray Silicone Co. Ltd.) | 10 parts |
| | Carbon black | 10 parts |

The coating material was mixed and dispersed using a Homo Mixer for 10 minutes to yield a coating composition. The coating composition and the core material were placed in a coater to thereby apply the coating composition to the core material. The coater had a rotary bottom disk and agitating blades in a fluidized bed to form a spiral flow. The coated article was fired in an electric furnace at 250° C. for 2 hours and thereby yielded the carrier.

Preparation of Low-molecular Weight Polyester 1

In a reactor equipped with a condenser, a stirrer and a nitrogen gas feed tube were placed 224 parts of an ethylene oxide (2 mole) adduct of bisphenol A, 561 parts of a propylene oxide (3 mole) adduct of bisphenol A, 217 parts of terephthalic acid, 46 parts of adipic acid and 3 parts of dibutyltin oxide. The mixture was reacted at 230° C. at normal atmospheric pressure for 7 hours and was further reacted at a reduced pressure of 10 to 15 mmHg for 5 hours. The reaction mixture was then treated with 42 parts of trimellitic anhydride at 180° C. at normal atmospheric pressure for 5 hours and thereby yielded Low-molecular Weight Polyester 1 having a number-average molecular weight of 2200, a weight-average molecular weight of 6600, a glass transition point Tg of 41° C., and an acid value of 22.

Preparation of Low-molecular Weight Polyesters 2, 3 and 4

Low-molecular Weight Polyesters 2, 3 and 4 having a number-average molecular weight of 4500, 6700 and 8100, respectively, were prepared by the procedure of the preparation of Low-molecular Weight Polyester 1, except for changing the reaction conditions.

Preparation of Prepolymer (Crosslinkable Resin) 1

In a reactor equipped with a condenser, a stirrer and a nitrogen gas feed tube were placed 685 parts of ethylene oxide (2 mole) adduct of bisphenol A, 81 parts of a propylene oxide (2 mole) adduct of bisphenol A, 281 parts of terephthalic acid, 24 parts of trimellitic anhydride and 3 parts of dibutyltin oxide. The mixture was reacted at 230° C. at normal atmospheric pressure for 10 hours, was further reacted under a reduced pressure of 10 to 15 mmHg for 8 hours and thereby yielded Intermediate Polyester 1 having a number-average molecular weight of 2200, a weight-average molecular weight of 9400, a glass transition point Tg of 53° C., an acid value of 0.4 and a hydroxyl value of 55.

In a reactor equipped with a condenser, a stirrer and a nitrogen gas feed tube were placed 414 parts of Intermediate Polyester 1, 86 parts of isophorone diisocyanate and 500 parts of ethyl acetate, followed by reaction at 100° C. for 8 hours to yield Prepolymer 1 having a free isocyanate content of 1.53% by weight.

Preparation of Ketimine Compound 1

In a reactor equipped with a stirring rod and a thermometer were placed 176 parts of isophoronediamine and 73 parts of methyl ethyl ketone, followed by reaction at 50° C. for 8 hours to yield Ketimine Compound 1 having an amine equivalent of 410.

Preparation of Master Batch 1

| | | |
|---|---|---|
| Pigment | Carbon black Regal 400R (Cabot Corp.) | 42 parts |
| Binder resin | Polyester resin RS-801 (Sanyo Chemical Industries, Ltd.; acid value: 10; Mw: 20000; Tg: 64° C.) | 63 parts |
| Water | | 30 parts |

The above materials were mixed in a Henschel Mixer to yield a mixture comprising pigment aggregates impregnated with water. The mixture was kneaded with a two-roll mill at a roll surface temperature of 135° C. for 70 minutes, was pulverized to a size of 1 mm in diameter by a pulverizer and thereby yielded Master Batch 1. Using Master Batch 1 as a pigment master batch, a toner was prepared in the following manner.

PREPARATION EXAMPLE 1

Toner Matrix 1

Preparation of Oil Phase

In a reactor equipped with a stirring rod and a thermometer were placed 375 parts of Low-molecular Weight Polyester 1, 110 parts of carnauba wax, 20 parts of a zinc complex of salicylic acid Bontron E-84 (trade name, available from Orient Chemical Industries, Ltd.) as a charge control agent (CCA) and 949 parts of ethyl acetate. The mixture was heated to 80° C., was held at 80° C. for 10 hours with stirring and was then cooled to 30° C. over 1 hour. The mixture was further treated with 500 parts of Master Batch 1 and 510 parts of ethyl acetate with stirring for 1 hour and thereby yielded Material Solution 1.

Next, 1324 parts of Material Solution 1 was placed in a vessel, and the carbon black and wax therein were dispersed using a bead mill (ULTRAVISCO-MILL available from Aimex Co., Ltd.) at a feeding speed of 1 kg/hr and a disc peripheral speed of 6 m/sec, using zirconia beads 0.5 mm in diameter filled 80% by volume. The dispersing procedure was repeated a total of three times. The dispersion was further treated with 1324 parts of a 65% solution of Low-molecular Weight Polyester 1 in ethyl acetate, and the mixture was dispersed under the above conditions, except that the dispersion procedure was performed once, to yield Pigment-wax Dispersion 1. Pigment-wax Dispersion 1 had a solid content of 50% as determined by heating at 130° C. for 30 minutes.

Preparation of Particle Dispersion 1

In a reactor equipped with a stirring rod and a thermometer were placed 683 parts of water, 14 parts of sodium salt of sulfuric acid ester of ethylene oxide adduct of methacrylic acid ELEMINOL RS 30 (trade name, available from Sanyo Chemical Industries, Ltd.), 137 parts of styrene, 138 parts of methacrylic acid and 1.2 parts of ammonium persulfate, and the mixture was stirred at 400 rpm for 15 minutes to yield a white emulsion. The emulsion was heated to an inner temperature of 75° C., followed by reaction for 4 hours. The reaction mixture was further treated with 30 parts of a 1% aqueous solution of ammonium persulfate, was aged at 71° C. for 6 hours and thereby yielded an aqueous dispersion [Particle Dispersion 1] of a vinyl resin (a copolymer of styrene methacrylic acid sodium salt of sulfuric acid ester of ethylene oxide adduct of methacrylic acid).

Preparation of Aqueous Phase 1

Aqueous Phase 1 was prepared by blending and stirring 990 parts of water, 80 part of Particle Dispersion 1, 38 parts of a 48.5% aqueous solution of sodium dodecyl diphenyl ether disulfonate ELEMINOL MON-7 (trade name, available from Sanyo Chemical Industries, Ltd., Japan), and 90 parts of ethyl acetate.

Emulsification and Solvent Removal

In a vessel were placed 648 parts of Pigment-wax Dispersion 1, 152 parts of Prepolymer 1 and 7.6 parts of Ketimine Compound 1, and the mixture was mixed at 5,000 rpm for 5 minutes with a T.K. HOMO MIXER (trade name, available from Tokushu Kika Kogyo Co., Ltd.). Next, the mixture was treated with 1,200 parts of Aqueous Phase 1 by dispersing at 14,000 rpm for 40 minutes with a T.K. HOMO MIXER and thereby yielded Emulsified Slurry 1.

In a vessel equipped with a stirrer and a thermometer was placed Emulsified Slurry 1 and was heated at 30° C. for 10 hours to remove the solvents therefrom, followed by aging at 45° C. for 6 hours to yield Dispersed Slurry 1 having a volume-average particle diameter of 5.75 μm and a number-average particle diameter of 5.2 μm as determined with Coulter Multilizer II (trade name, available from Bechman Coulter).

Washing and Drying

A total of 100 parts of Dispersed Slurry 1 was filtered under a reduced pressure and was washed by the following procedures.

(1) The filtered cake and 100 parts of deionized water were mixed using a T.K. HOMO MIXER at 13,000 rpm for 10 minutes, and the mixture was filtered.

(2) The filtered cake prepared in (1) and 100 parts of a 10% aqueous solution of sodium hydroxide were mixed using a T.K. HOMO MIXER at 13,000 rpm for 30 minutes under ultrasonic vibration, and the mixture was filtered under a reduced pressure. This ultrasonic alkali-washing was repeated again, i.e., the ultrasonic alkali-washing was performed a total of two times.

(3) The filtered cake prepared in (2) and 100 parts of a 10% hydrochloric acid were mixed using a T.K. HOMO MIXER at 13,000 rpm for 10 minutes, and the mixture was filtered.

(4) The filtered cake prepared in (3) and 300 parts of ion-exchanged water were mixed using a T.K. HOMO MIXER at 13,000 rpm for 10 minutes, and the mixture was filtered, wherein this washing procedure was further repeated twice to yield Filtered Cake 1.

Filtered Cake 1 was dried at 45° C. for 48 hours in a circulating air dryer, was sieved through a 75-μm mesh sieve and thereby yielded Toner Matrix 1 having a volume-average particle diameter Dv of 6.1 μm, a number-average particle diameter Dn of 5.5 μm, and a ratio Dv/Dn of 1.11 as determined with Coulter Multilizer II (trade name, available from Bechman Coulter).

PREPARATION EXAMPLES 2, 3 AND 4

Toner Matrixes 2, 3 and 4

Toner Matrixes 2, 3 and 4 were prepared by the procedure of Preparation Example 1, except for using Low-molecular Weight Polyesters 2, 3 and 4, respectively, instead of Low-molecular Weight Polyester 1.

PREPARATION EXAMPLE 5

Toner Matrix 5

Toner Matrix 5 was prepared by the procedure of Preparation Example 1, except for using Ketimine Compound 1 in an amount of 2.0 parts.

EXAMPLES 1 TO 4

Toners 1 to 4 were prepared by adding 1.0% by weight of silica particles HDK H 2000 (trade name, available from Clariant Japan K.K.), followed by preparation of developers using them. The properties of Toners 1 to 4 and the developers were determined with Test Machine A.

COMPARATIVE EXAMPLE 1

Toner 5 and a developer were prepared by the procedure of Example 1, except for using Toner Matrix 5 instead of Toner Matrix 1, followed by evaluation of their properties.

The physical properties and qualities of the toners and developers are shown in Table 1.

TABLE 1

| | Physical Properties and Quality of Toners | | | | | | | | | | |
|---|---|---|---|---|---|---|---|---|---|---|---|
| | | | | | | Particle size | | | Quality | | |
| | Viscosity (*1000 Pa · s) | | tan δ | | Softening | Volume-average particle | | | Toner deposition on | Image-fixing | Cleaning |
| Toner | 140° C. | 170° C. | 140° C. | 170° C. | point (° C.) | diameter Dv | Dv/Dn | Sphericity | background | property | property |
| Toner 1 | 26 | 1.5 | 0.88 | 0.42 | 42 | 5.2 | 1.1 | 0.97 | B | A | A |
| Toner 2 | 33 | 2.2 | 0.92 | 0.51 | 45 | 5.3 | 1.2 | 0.98 | B | B | A |
| Toner 3 | 48 | 4.3 | 0.98 | 0.62 | 48 | 5.1 | 1.1 | 0.97 | B | B | B |

TABLE 1-continued

| Physical Properties and Quality of Toners | | | | | | | | | | | |
|---|---|---|---|---|---|---|---|---|---|---|---|
| | | | | | | Particle size | | | Quality | | |
| | Viscosity (*1000 Pa · s) | | tan δ | | Softening | Volume-average particle | | | Toner deposition on | Image-fixing | Cleaning |
| Toner | 140° C. | 170° C. | 140° C. | 170° C. | point (° C.) | diameter Dv | Dv/Dn | Sphericity | background | property | property |
| Toner 4 | 60 | 5.2 | 1.05 | 0.82 | 55 | 5.4 | 1.1 | 0.96 | B | C | B |
| Toner 5 | 18 | 0.5 | 0.65 | 0.32 | 42 | 5.2 | 1.2 | 0.97 | B | D | B |

A: Excellent
B: Good
C: Fair
D: Failure

As is described above, the present invention can provide a toner having excellent offset resistance and image-fixing properties. The image forming process and process cartridge of the present invention using the toner can produce high-quality images.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner for electrophotography, comprising a binder resin comprising a linear polymer having a softening point of 50° C. or lower, a colorant and a releasing agent, being in the form of particles and having a viscosity, a storage modulus G' and a loss modulus G", wherein the viscosity is $1\times10^3$ Pa·s or more, and a loss tangent tan δ as the ratio of G' to G" is 0.4 or more at temperatures from 140° C. to 170° C.

2. A toner for electrophotography according to claim 1, wherein the viscosity is $1\times10^5$ Pa·s or less at temperatures from 140° C. to 170° C.

3. A toner for electrophotography according to claim 1, wherein the loss tangent tan δ is 1.1 or less at temperatures from 140° C. to 170° C.

4. A toner for electrophotography according to claim 1, wherein pellets prepared from the toner by compression molding have a contact angle with water of 70 degrees or more.

5. A toner for electrophotography according to claim 1, wherein the toner particles have a volume-average particle diameter Dv of 4 μm to 8 μm.

6. A toner for electrophotography according to claim 1, wherein the toner particles have a ratio Dv/Dn of a volume-average particle diameter Dv to a number-average particle diameter Dn, being 1.25 or less.

7. A toner for electrophotography according to claim 6, wherein the toner particles have a ratio Dv/Dn of a volume-average particle diameter Dv to a number-average particle diameter Dn, being 1.10 or more.

8. A toner for electrophotography according to claim 1, wherein the toner particles have an average sphericity of 0.94 to 0.99.

9. A toner for electrophotography according to claim 8, wherein the average sphericity is from 0.945 to 0.985.

10. A toner for electrophotography according to claim 1, wherein the binder resin comprises a crosslinked polymer.

11. A toner for electrophotography according to claim 1, wherein the binder resin comprises at least one of a polyester resin and a polyol resin.

12. A toner for electrophotography according to claim 1, wherein the releasing agent is at least one selected from the group consisting of unesterified fatty acid eliminated carnauba wax, montan ester wax, rice wax and Sasol wax.

13. An image forming process comprising the steps of:

charging a latent electrostatic image bearing member with a charger which is applied with a voltage;

irradiating the latent electrostatic image bearing member with light so as to form a latent electrostatic image;

developing the latent electrostatic image using a toner so as to form a toner image;

transferring the toner image from the latent electrostatic image bearing member to a transfer medium; and fixing the toner image on the transfer medium, wherein the toner is a toner for electrophotography, comprising a binder resin comprising a linear polymer having a softening point of 50° C. or lower, a colorant and a releasing agent, being in the form of particles and having a viscosity, a storage modulus G' and a loss modulus G", wherein the viscosity is $1\times10^3$ Pa·s or more and a loss tangent tan δ as the ratio of G' to G" is 0.4 or more at temperatures from 140° C. to 170° C.

14. An image forming process according to claim 13, further comprising a step of applying an alternating electric field at the same time of developing the latent electrostatic image.

15. An image forming process according to claim 13, wherein the latent electrostatic image bearing member is an amorphous silicon latent electrostatic image bearing member.

* * * * *